US011844747B2

(12) United States Patent
Eicke

(10) Patent No.: US 11,844,747 B2
(45) Date of Patent: Dec. 19, 2023

(54) CAPPING SYSTEM FOR LIQUID MEDICINE BOTTLES

(71) Applicant: Jason Eicke, Happy, TX (US)

(72) Inventor: Jason Eicke, Happy, TX (US)

( * ) Notice: Subject to any disclaimer, the term of this patent is extended or adjusted under 35 U.S.C. 154(b) by 596 days.

(21) Appl. No.: 16/879,901

(22) Filed: May 21, 2020

(65) Prior Publication Data

US 2020/0368106 A1 Nov. 26, 2020

Related U.S. Application Data

(60) Provisional application No. 62/851,148, filed on May 22, 2019.

(51) Int. Cl.

| | |
|---|---|
| ***A61J 1/14*** | (2023.01) |
| ***B65D 51/00*** | (2006.01) |
| ***A61J 1/20*** | (2006.01) |

(52) U.S. Cl.

CPC ..... *A61J 1/1418* (2015.05); *A61J 1/201* (2015.05); *A61J 1/2068* (2015.05); *B65D 51/002* (2013.01)

(58) Field of Classification Search

CPC ..... A61J 1/1418; A61J 1/201; A61J 1/2068; B65D 51/002

See application file for complete search history.

(56) References Cited

U.S. PATENT DOCUMENTS

| | | | | |
|---|---|---|---|---|
| 4,588,403 | A | 5/1986 | Weiss et al. | |
| 5,454,409 | A | 10/1995 | McAffer et al. | |
| 6,258,078 | B1 | 7/2001 | Thilly | |
| 8,025,653 | B2 * | 9/2011 | Capitaine | A61M 39/18 604/411 |
| 8,197,459 | B2 * | 6/2012 | Jansen | A61J 1/2096 604/414 |
| 8,562,582 | B2 * | 10/2013 | Tuckwell | A61J 1/2051 138/167 |
| 9,180,070 | B2 * | 11/2015 | Carrel | A61J 1/2096 |
| 9,549,873 | B2 * | 1/2017 | Barrelle | A61J 1/1406 |
| 9,668,939 | B2 * | 6/2017 | Carrel | A61J 1/2082 |
| 10,245,380 | B2 * | 4/2019 | Fisher | B01L 3/508 |

OTHER PUBLICATIONS

International Search Report and Written Opinion for PCT/US20/34108 (dated Aug. 31, 2020).

* cited by examiner

*Primary Examiner* — Ernesto A Grano
(74) *Attorney, Agent, or Firm* — Kirby Drake

(57) ABSTRACT

A save-and-draw capping system may be snapped or otherwise attached/connected to the top of a liquid medicine bottle having a rubber surface that may be punctured using a syringe to draw medicine. Using the save-and-draw capping system, the rubber surface may be sealed after it has been punctured. A secondary seal may be used to apply pressure to the cap of the liquid medicine bottle. A draw attachment, such as a draw needle, may be attached to the save-and-draw cap so that a hose may be connected to the liquid medicine bottle when multiple injections are needed. The save-and-draw capping system may be removed from one liquid medicine bottle to be used on another liquid medicine bottle.

14 Claims, 10 Drawing Sheets

CAPPING SYSTEM FOR LIQUID MEDICINE BOTTLES

CROSS-REFERENCE TO RELATED APPLICATION

The present application claims priority to U.S. Provisional Application No. 62/851,148 filed May 22, 2019, the disclosure of which is incorporated by reference in its entirety.

FIELD OF THE DISCLOSURE

The present disclosure generally relates to liquid medicine bottles, and more particularly to a save-and-draw capping system for use on liquid medicine bottles.

BACKGROUND

Medicine bottles with aluminum caps with a rubber surface in the center are typically used for filling syringes. Once punctured, the rubber surface does not always seal properly. In many applications, the bottle can be used more than once for multiple injections. The possibility for medicine to leak increases with every needle puncture that the rubber surface sustains. Given the high cost of certain medicines, it is problematic when a user consumes a portion of liquid in a bottle, takes the bottle to another location, only to find that all or a portion of the remaining liquid has leaked out.

SUMMARY

Embodiments of the present disclosure may provide a save-and-draw capping system that may be snapped or otherwise attached/connected to the top of a liquid medicine bottle having a rubber surface that may be punctured using a syringe to draw medicine. Using the save-and-draw capping system according to embodiments of the present disclosure, the rubber surface of the liquid medicine bottle may be sealed after it has been punctured. A secondary seal may be used to apply pressure to the cap of the liquid medicine bottle in embodiments of the present disclosure.

In some embodiments of the present disclosure, a draw device, such as a draw needle, may be attached as part of the save-and-draw capping system so that a hose may be connected to the liquid medicine bottle when multiple injections are needed. The save-and-draw capping system may be removed from one liquid medicine bottle to be used on another liquid medicine bottle in embodiments of the present disclosure.

Other embodiments of the present disclosure may provide a save-and draw capping system comprising: a clamping system that connects to an upper ring of a liquid medicine bottle; a locking seal having an orifice, the locking seal screwed to the clamping system, thereby creating a positive seal for the liquid medicine bottle once tightened; a cap connected to the locking seal, the cap having a seal surface that seats into a sealing surface of the orifice of the locking seal; and a draw attachment, wherein the cap covers a rubber surface of a liquid medicine bottle so that it remains sealed once the rubber surface has been punctured by the draw attachment. The clamping system may be comprised of two clamps. The cap may be a flip-top cap having a plastic hinge. The flip-top cap may further comprise a raised nipple on a bottom side that receives a rubber hose for use of the save-and-draw capping system with a remote injection gun. The cap may be a screw-on cap. The locking seal may have a sealing surface on a base that uses the rubber surface of the liquid medicine bottle to form a seal. The draw attachment may include a tab and a slot capable of attachment to a top of the liquid medicine bottle. The attachment may be through threading or friction. The draw attachment may include a vent to receive air while not letting liquid leak out of the cap when placed on the draw attachment. The save-and-draw capping system may be sized and shaped to fit more than one type of liquid medicine bottle.

Additional embodiments of the present disclosure may provide a save-and draw capping system comprising: a clamping system that connects to an upper ring of a liquid medicine bottle; and a cap secured to the clamping system, the cap having a flip-top lid with a hinge and a seal surface that seats into an orifice of the clamping system. The system may further comprise a draw attachment that accesses contents of the liquid medicine bottle through puncturing a rubber surface of the liquid medicine bottle, wherein the cap may be closed to cover and seal rubber surface of a liquid medicine bottle once the rubber surface has been punctured by the draw attachment. The draw attachment may be inserted into the liquid medicine bottle by opening the flip-top lid.

Further embodiments of the present disclosure may provide a save-and draw capping system comprising: a draw attachment inserted into a liquid medicine bottle and capable of accessing contents of the liquid medicine bottle; a snap-on system having an orifice and snap-on fingers positioned in a channel of the draw attachment, the snap-on fingers capable of gripping sides of the liquid medicine bottle; and a cap connected to the snap-on system, the cap having a seal surface that seats into a sealing surface of the orifice of the snap-on system, wherein a rubber surface of a liquid medicine bottle remains sealed once the rubber surface has been punctured by the draw attachment. The draw attachment may include a vent to receive air while not letting liquid leak out of the cap when placed on the draw attachment. The cap may be a flip-top cap having a plastic hinge. The cap may further comprise a raised nipple on a bottom side that receives a rubber hose for use of the save-and-draw capping system with a remote injection gun.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a save-and-draw capping system that may snap on top of or otherwise connect/attach to liquid medicine bottles. As described herein, a save-and-draw capping system may include a combination of a clamping system, a locking seal, and a cap or draw attachment, such as will be described herein with respect to FIGS. 1A-1G. In other embodiments of the present disclosure, a save-and-draw capping system may include a clamping system with a flip-top cap and a draw attachment such as depicted in FIGS. 2A-2G, described in more detail herein. Additional embodiments of the present disclosure may provide a save-and-draw capping system that may include a snap-on system with a draw attachment, as will be described in more detail with respect to FIGS. 3A-3D.

Figure 1A:
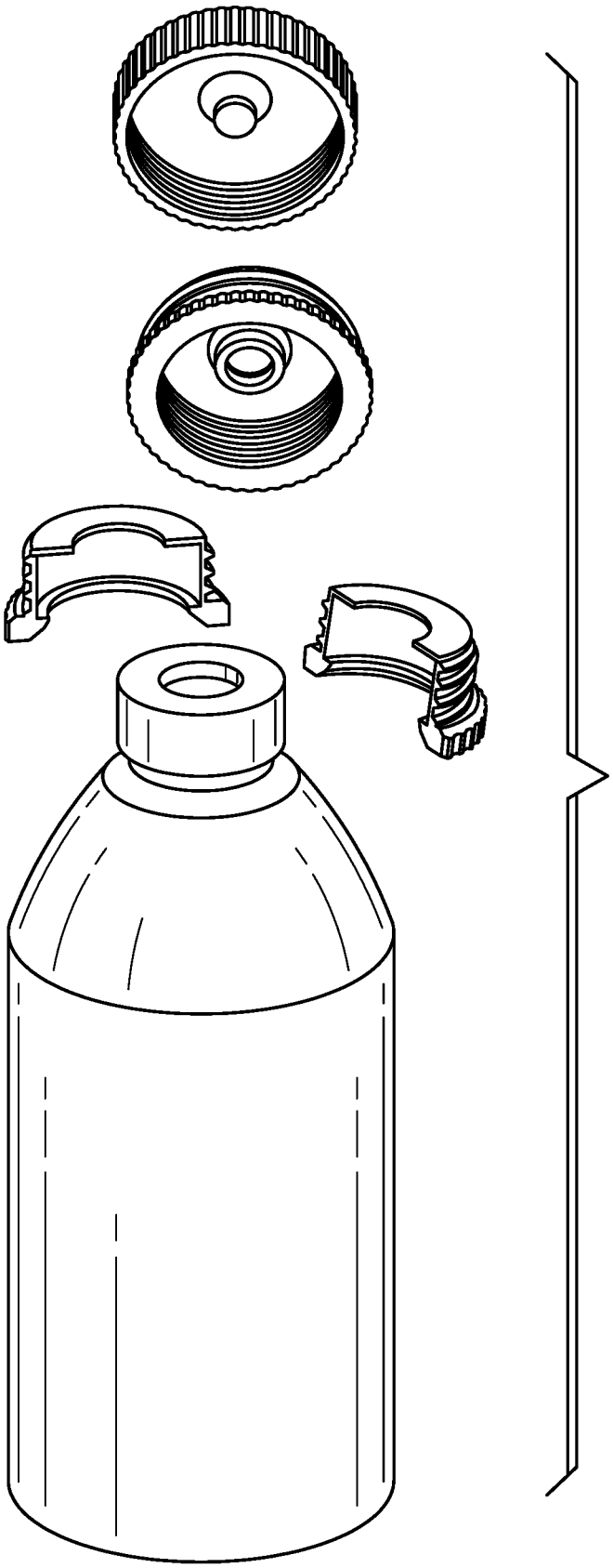
FIG. 1A depicts an exploded view of a clamping system for a liquid medicine bottle according to an embodiment of the present disclosure.
Figure 1D:
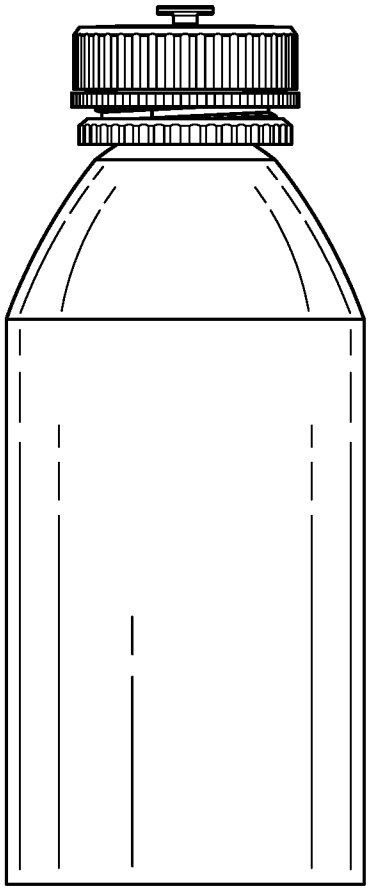
FIG. 1D depicts the liquid medicine bottle of FIG. 1C including a cap connected to the locking seal according to an embodiment of the present disclosure.
Figure 1C:
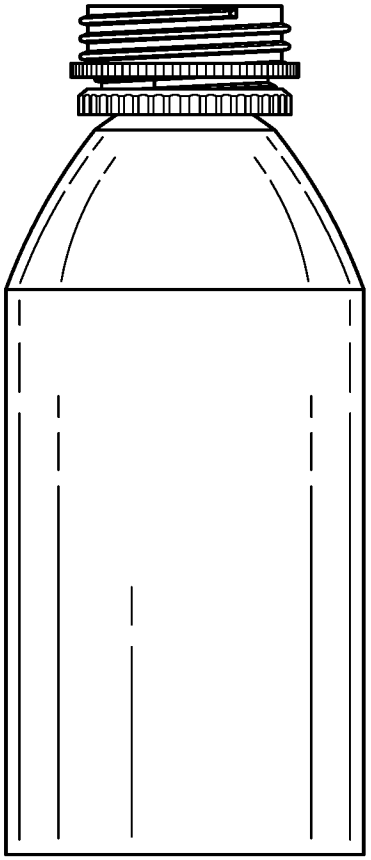
FIG. 1C depicts the liquid medicine bottle of FIG. 1B including a locking seal attached to the clamping system according to an embodiment of the present disclosure.
Figure 1B:
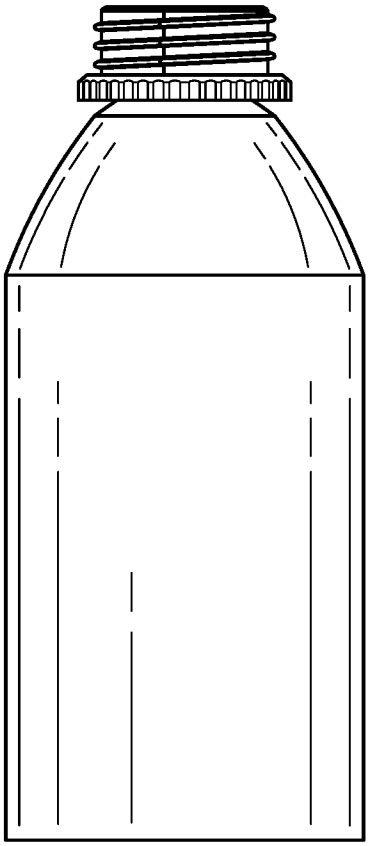
FIG. 1B depicts a liquid medicine bottle with the clamping system attached according to an embodiment of the present disclosure.
Figure 1E:
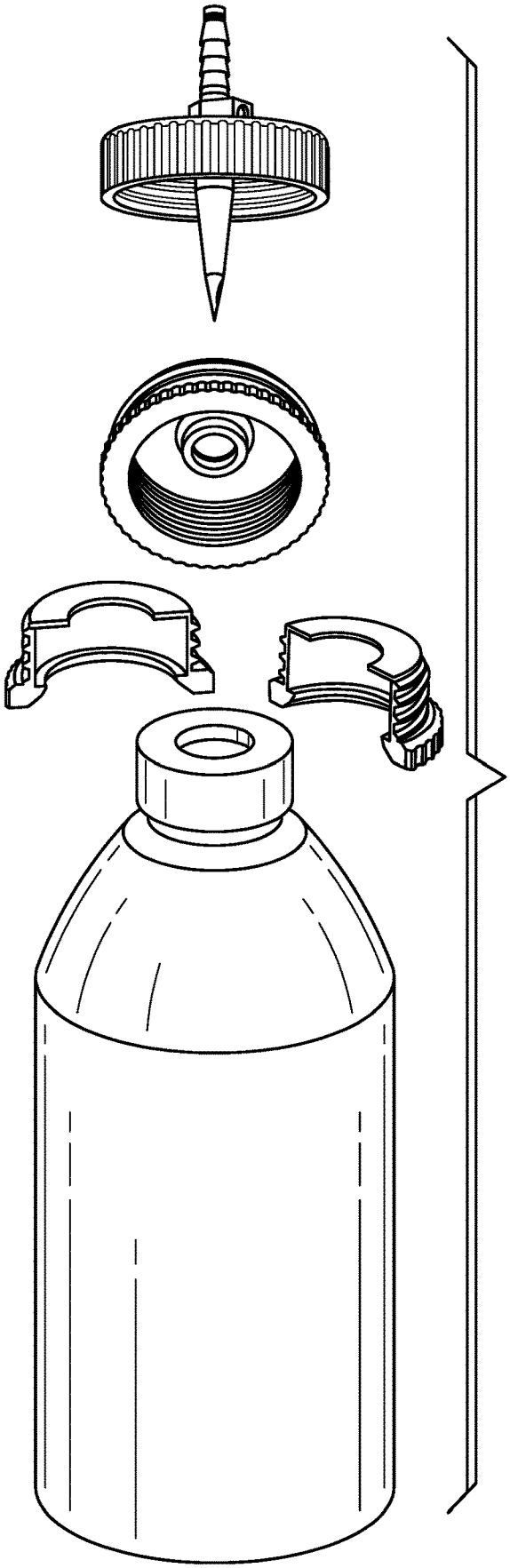
FIG. 1E depicts an exploded view of a clamping system with a draw attachment for a liquid medicine bottle according to an embodiment of the present disclosure.
Figure 1F:
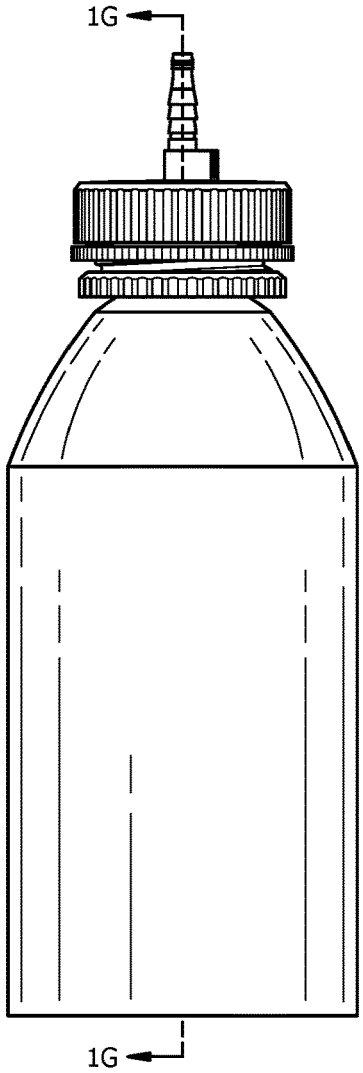
FIG. 1F depicts the liquid medicine bottle of FIG. 1E when the draw attachment, locking seal, and clamping system are attached according to an embodiment of the present disclosure.
Figure 1G:
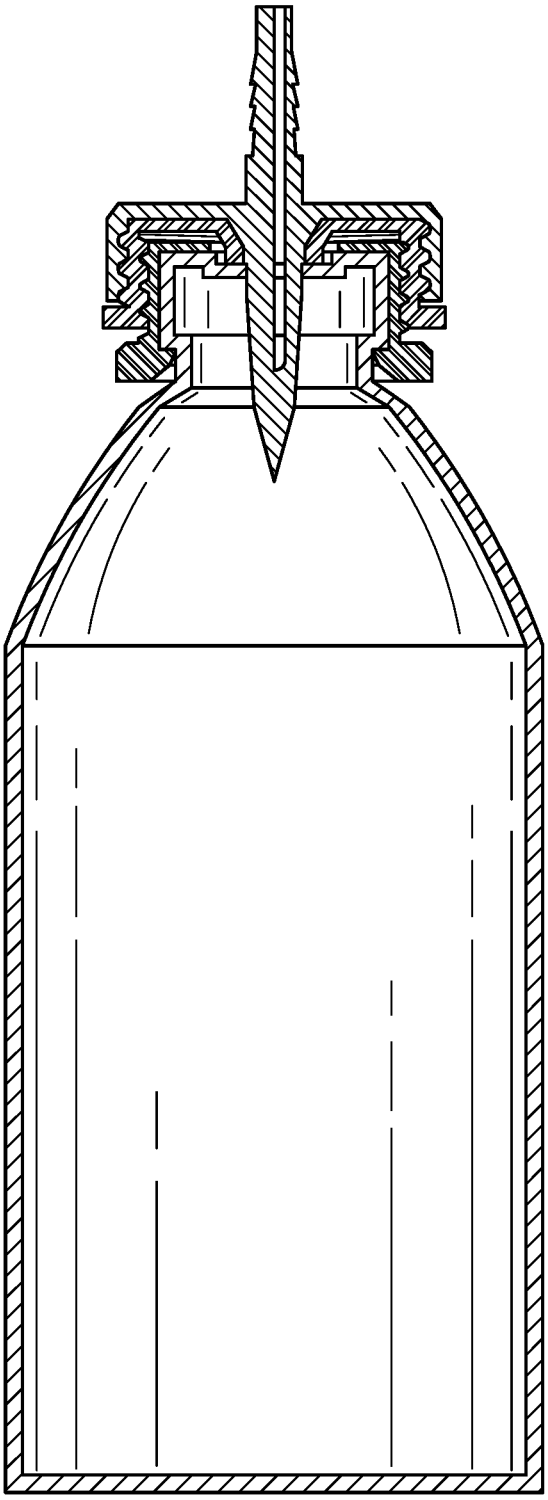
FIG. 1G depicts a cutaway view of the liquid medicine bottle of FIG. 1F showing how the draw attachment is positioned within the locking seal and clamping system according to an embodiment of the present disclosure.

FIG. 1A depicts an exploded view of a clamping system for a liquid medicine bottle according to an embodiment of the present disclosure. The clamping system may be formed of two clamps that may connect to an upper ring of the liquid medicine bottle. FIG. 1B depicts a liquid medicine bottle with the clamping system attached according to an embodiment of the present disclosure. A locking seal may then be screwed to the clamping system. FIG. 1C depicts the liquid medicine bottle of FIG. 1B including a locking seal attached to the clamping system according to an embodiment of the present disclosure. A sealing surface on the base of the locking seal may use the rubber of the bottle to form a seal. By connecting the locking seal to the clamping system, a positive seal may be created once tightened. A cap or draw attachment may then be connected to the locking seal. The cap may include a seal surface that may seat into a sealing surface orifice to create a tight seal. FIG. 1D depicts the liquid medicine bottle of FIG. 1C including a cap or draw attachment connected to the locking seal according to an embodiment of the present disclosure. FIG. 1E depicts an exploded view of a clamping system with a draw attachment for a liquid medicine bottle according to an embodiment of the present disclosure, and FIG. 1F depicts the liquid medicine bottle of FIG. 1E when the draw attachment, locking seal, and clamping system are attached according to an embodiment of the present disclosure. FIG. 1G depicts a cutaway view of the liquid medicine bottle of FIG. 1F showing how the draw attachment is positioned within the locking seal and clamping system according to an embodiment of the present disclosure.

Figure 2A:
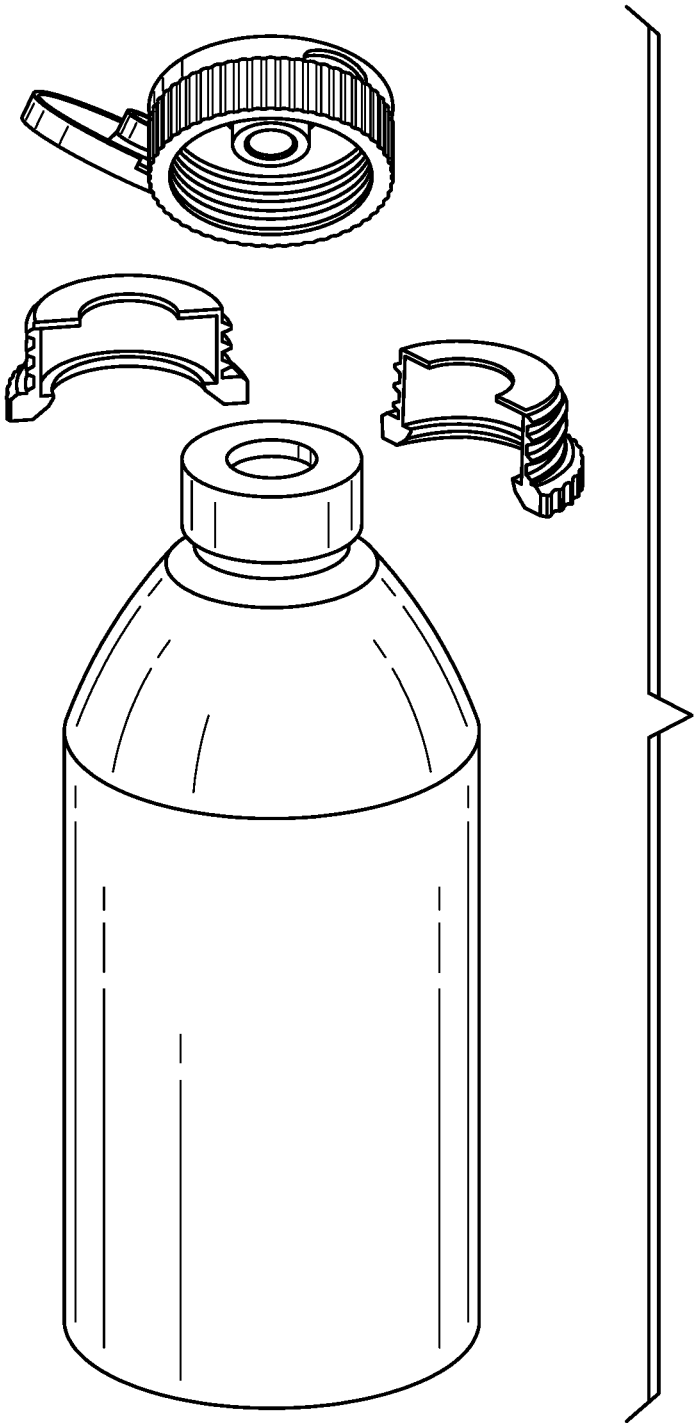
FIG. 2A depicts an exploded view of a clamping system with a flip-top cap for a liquid medicine bottle according to an embodiment of the present disclosure.
Figures 2B, 2C, 2D:
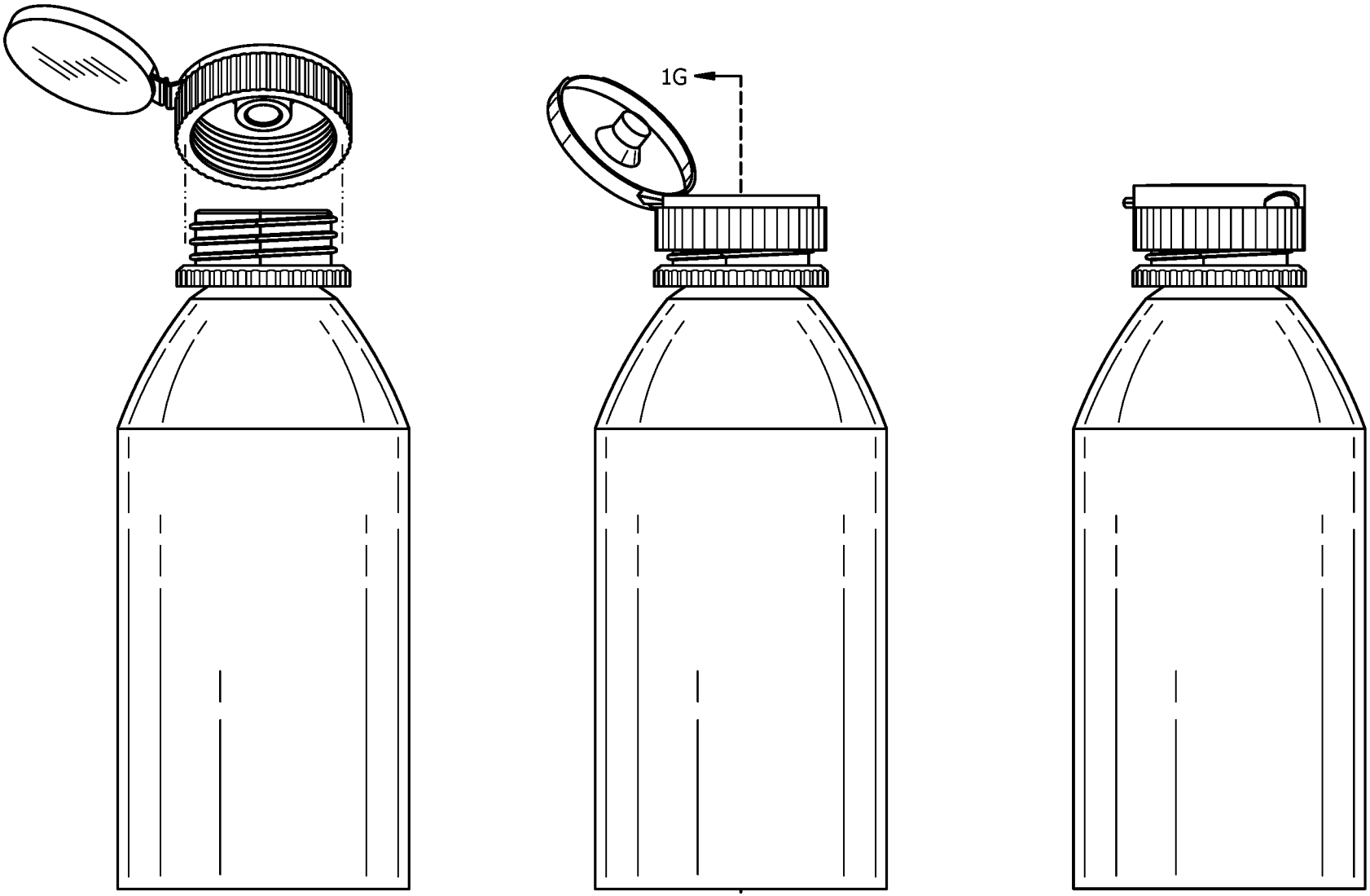
FIG. 2B depicts a flip-top cap separated from the clamping system for a liquid medicine bottle according to an embodiment of the present disclosure.
FIG. 2C depicts the liquid medicine bottle of FIG. 2B when an open flip-top cap has been placed on the clamping system according to an embodiment of the present disclosure.
FIG. 2D depicts the liquid medicine bottle of FIG. 2C when the flip-top cap is closed according to an embodiment of the present disclosure.

FIG. 2A depicts an exploded view of a clamping system with a flip-top cap for a liquid medicine bottle according to an embodiment of the present disclosure. In this embodiment, a cap may be used that flips on a plastic hinge as opposed to using a separate screw-on cap as depicted in FIGS. 1A-1G. The plastic hinge according to embodiments of the present disclosure may be a three-section plastic hinge; however, it may have more or fewer sections and may be constructed of a material other than plastic without departing from the present disclosure. FIG. 2B depicts a flip-top cap separated from the clamping system for a liquid medicine bottle according to an embodiment of the present disclosure. FIG. 2C depicts the liquid medicine bottle of FIG. 2B when an open flip-top cap has been placed on the clamping system according to an embodiment of the present disclosure. FIG. 2D depicts the liquid medicine bottle of FIG. 2C when the flip-top cap is closed according to an embodiment of the present disclosure. When the save-and-draw cap is installed, a rubber hose may attach to a raised nipple on the bottom side of a flip-top cap so that it may be used with remote injection guns.

Figure 2E:
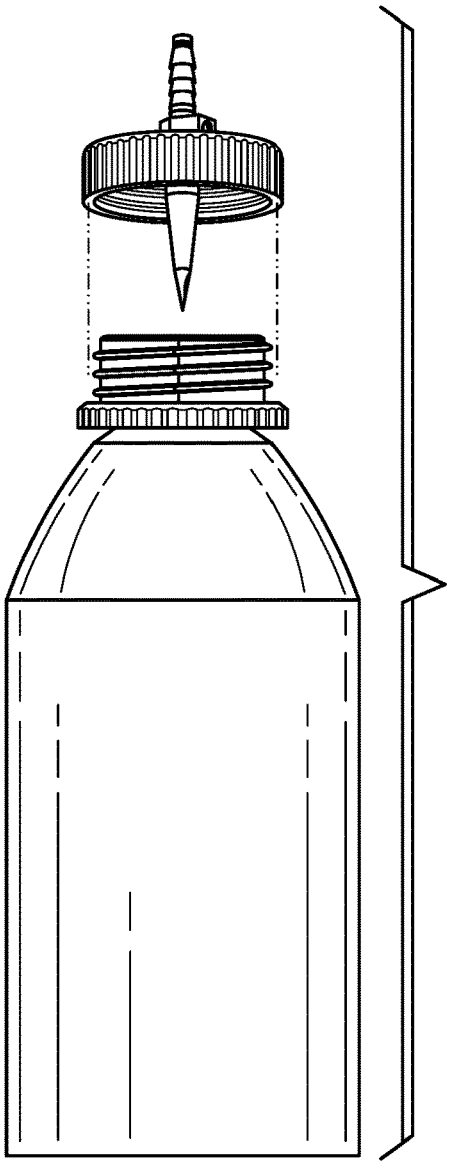
FIG. 2E depicts an exploded view of the liquid medicine bottle of FIG. 2B where the flip-top cap has been removed and replaced with a draw attachment according to an embodiment of the present disclosure.
Figure 2F:
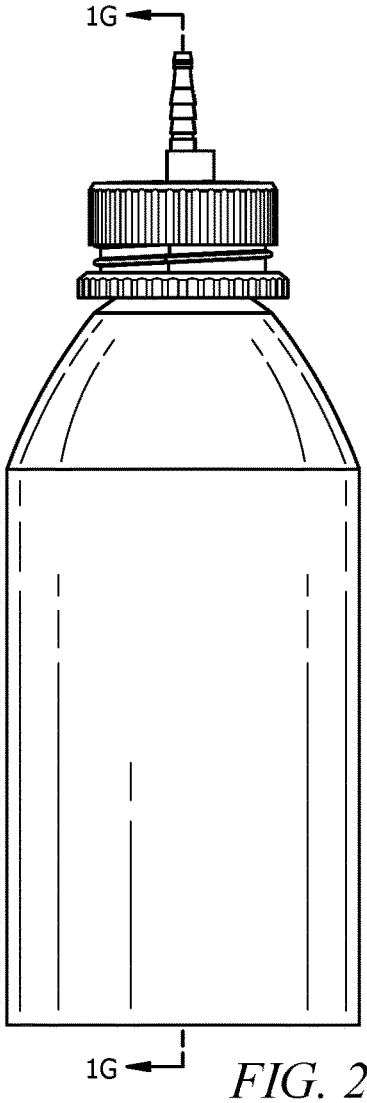
FIG. 2F depicts the liquid medicine bottle of FIG. 2E when the draw attachment is attached according to an embodiment of the present disclosure.
Figure 2G:
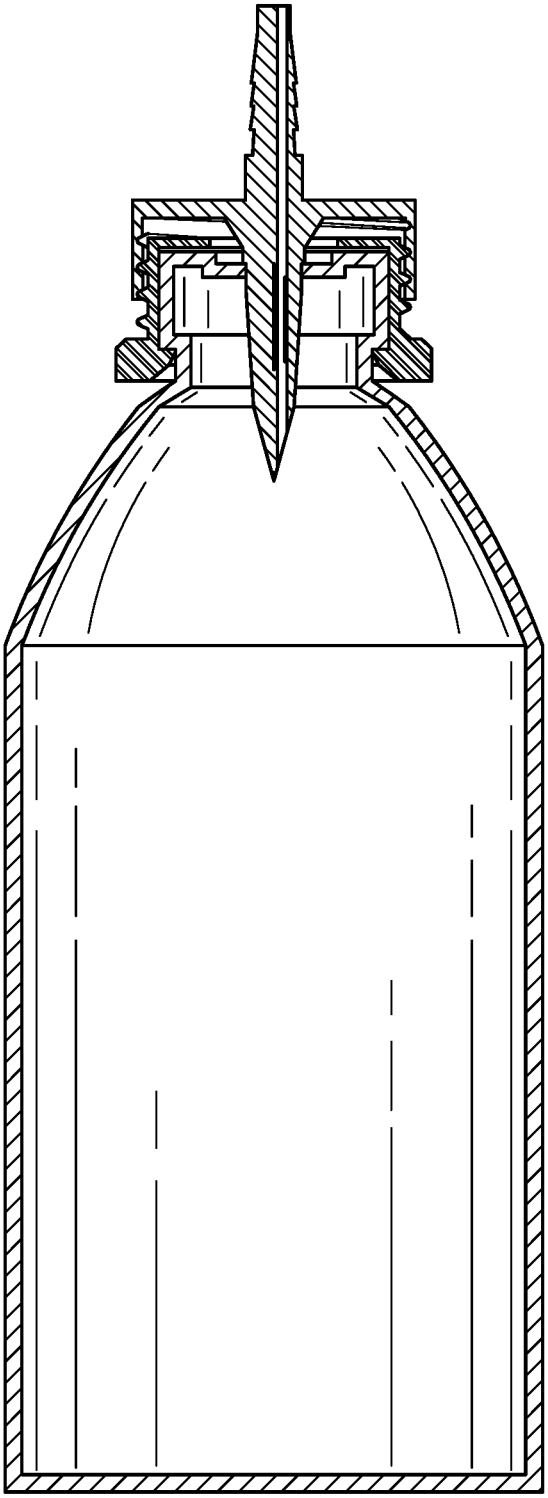
FIG. 2G depicts a cutaway view of the liquid medicine bottle of FIG. 2F showing how the draw attachment is positioned within the clamping system according to an embodiment of the present disclosure.

FIG. 2E depicts an exploded view of the liquid medicine bottle of FIG. 2B where the flip-top cap has been removed and replaced with a draw attachment according to an embodiment of the present disclosure. The draw attachment may include a tab and slot for attachment to the top of the liquid medicine bottle. In some embodiments of the present disclosure, it may be threaded, may use friction, or may use another means of attachment. FIG. 2F depicts the liquid medicine bottle of FIG. 2E when the draw attachment is attached according to an embodiment of the present disclosure. Accordingly, by unscrewing and removing the flip-top cap, a draw attachment may be used. FIG. 2G depicts a cutaway view of the liquid medicine bottle of FIG. 2F showing how the draw attachment is positioned within the clamping system according to an embodiment of the present disclosure.

Figure 3A:
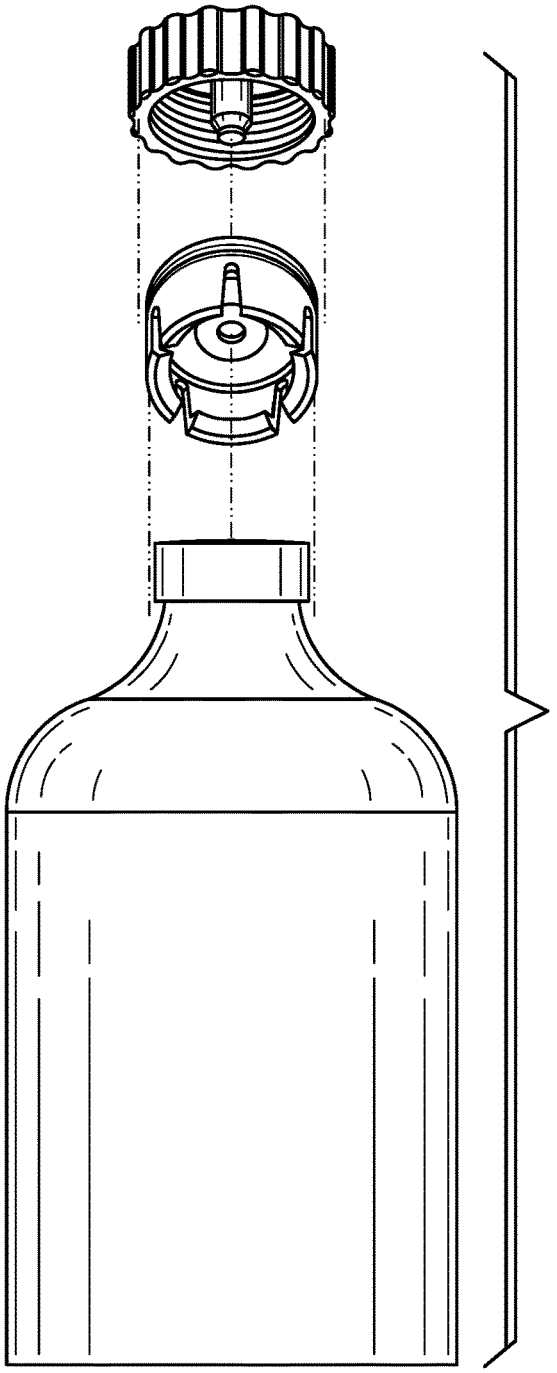
FIG. 3A depicts an exploded view of a snap-on system for a liquid medicine bottle according to an embodiment of the present disclosure.

FIG. 3A depicts an exploded view of a snap-on system for a liquid medicine bottle according to an embodiment of the present disclosure. The snap-on system may include snap-on fingers in the draw attachment channel as depicted in FIG. 3A that may grip the sides or bottom of the liquid medicine bottle similar to the clamping system described in other embodiments of the present disclosure. There may be a vent that may allow air to enter the liquid medicine bottle during use while not allowing liquid to leak out of the bottle. The draw device also may include a vent hole as depicted in FIG. 3A. The draw vent may include a slit to allow air in while not letting liquid leak out of the draw cap. As depicted herein, a cap (similar to that depicted in FIG. 1A) may be placed on top of the snap-on system to close the liquid medicine bottle. However, while not depicted herein, a flip-top cap may be substituted for the cap depicted in FIG. 3A in embodiments of the present disclosure.

Figure 3B:
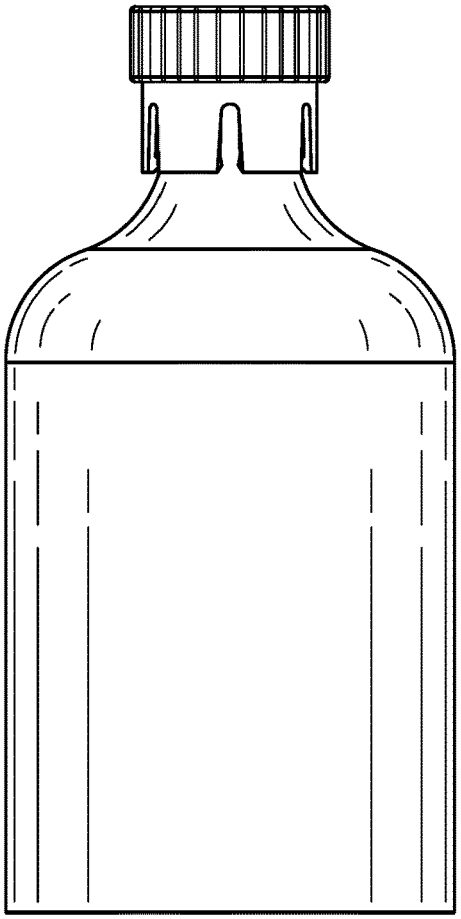
FIG. 3B depicts the snap-on system connected to the liquid medicine bottle according to an embodiment of the present disclosure.
Figure 3C:
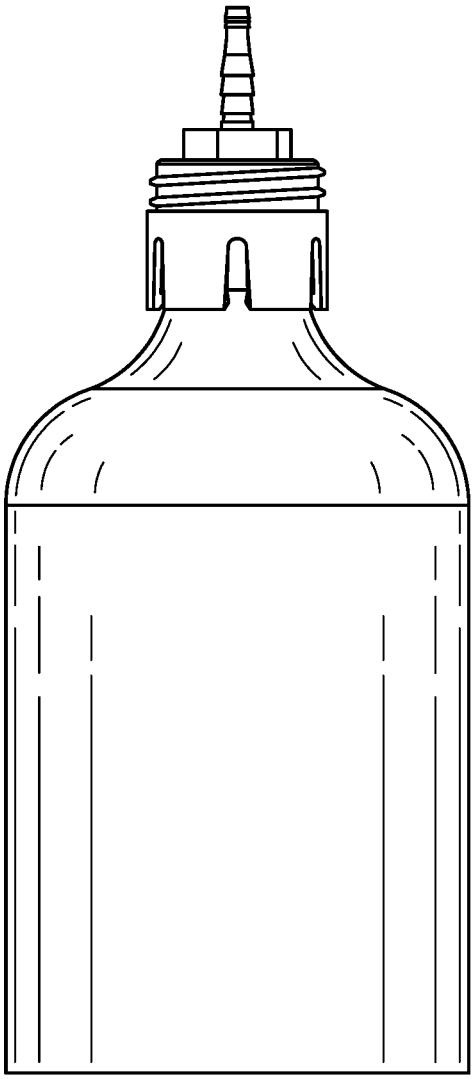
FIG. 3C depicts the liquid medicine bottle of FIG. 3A where a draw attachment replaces the snap-on system according to an embodiment of the present disclosure.
Figure 3D:
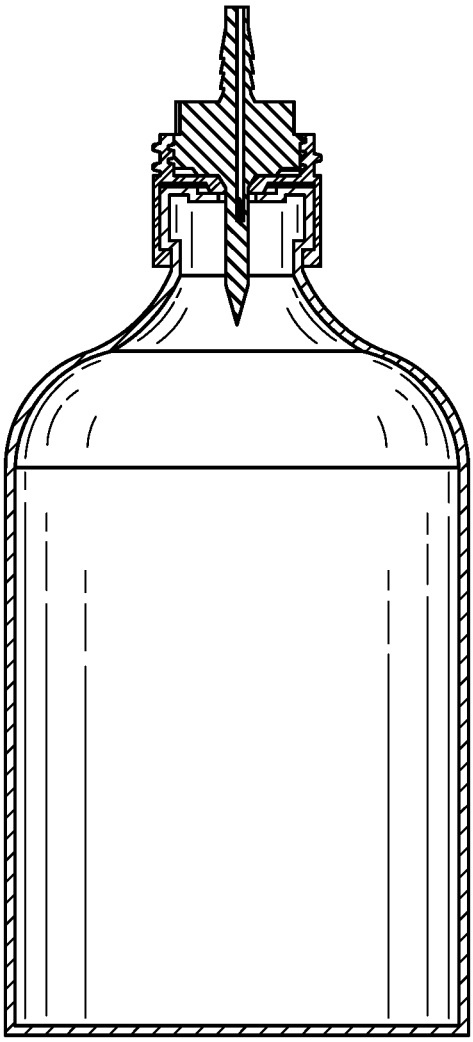
FIG. 3D depicts a cutaway view of the liquid medicine bottle of FIG. 3C showing how the draw attachment is positioned within the liquid medicine bottle according to an embodiment of the present disclosure.

FIG. 3B depicts the snap-on system connected to the liquid medicine bottle according to an embodiment of the present disclosure. FIG. 3C depicts the liquid medicine bottle of FIG. 3A where a draw attachment replaces the snap-on system according to an embodiment of the present disclosure. FIG. 3D depicts a cutaway view of the liquid medicine bottle of FIG. 3C showing how the draw attachment is positioned within the liquid medicine bottle according to an embodiment of the present disclosure. In this embodiment, the fluid port of the draw attachment is depicted herein.

As described in embodiments herein, the base of a save-and-draw cap may clip to the top of a liquid medicine bottle, thereby securing the save-and-draw cap in place. In an embodiment of the present disclosure, a top portion of the save-and-draw cap may be a hinged or flip top cap (see, e.g., FIG. 2A) so that the save-and-draw cap may be opened and closed to access the contents of the liquid medicine bottle to which it is secured in embodiments of the present disclosure. Liquid medicine bottles as described in embodiments of the present disclosure are typically those that have an aluminum or stainless-steel cap with a rubber surface in the center so that a syringe may puncture the rubber surface to draw liquid medicine from the bottle. Seals may be provided on the save-and-draw cap and under the snap-on base of the cap to stop liquid from leaking out of the liquid medicine bottle when the save-and draw cap is used according to embodiments of the present disclosure. In some embodiments of the present disclosure, the top surface of the save-and draw cap may include one or more mechanical devices that may hold a draw needle in place.

Using a save-and-draw capping system according to embodiments of the present disclosure, the rubber surface of a liquid medicine bottle may remain sealed once the rubber surface has been punctured. The lid can be snapped closed, thereby sealing the cap against the rubber surface of the liquid medicine bottle. The liquid medicine bottle may then be safely transported and stored without losing liquid from the bottle. Pressure may be applied to the rubber surface by a raised nipple on the bottom side of a flip-top cap. There may be a secondary seal that may apply pressure to the surface of the aluminum or stainless bottle top in embodiments of the present disclosure.

In embodiments of the present disclosure, a draw needle may be attached to the save-and-draw capping system when it is in an open position. A hose may be connected to a tip of the draw needle to engage the medicine bottle, and the other end of the hose may be attached to a syringe gun that may be used to deliver multiple injections. In an embodiment of the present disclosure, a syringe gun may be used to deliver vaccinations to multiple cows at a time. The save-and-draw capping system may be sealed to safely transport the liquid medicine bottle to another location for use. Once at the next location, the save-and-draw cap may be flipped open, and a syringe or draw needle may be attached and used to draw medicine through the rubber surface. The save-and-draw capping system according to embodiments of the present disclosure may be removable so that, for example, when no more liquid remains in a first medicine bottle, the save-and-draw capping system may be removed from the first medicine bottle and attached to another medicine bottle.

It should be appreciated that the save-and-draw capping system according to embodiments of the present disclosure may be sized and shaped to fit different types of liquid medicine bottles. It also should be appreciated that the save-and-draw capping system according to embodiments of the present disclosure may be formed of materials similar to or different from the standard cap without departing from the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A save-and draw capping system comprising:

a clamping system comprised of two clamps not integral to each other that combine to substantially surround and connect to an upper ring of a liquid medicine bottle;

a locking seal having an orifice, the locking seal screwed to the clamping system, thereby creating a positive seal for the liquid medicine bottle once tightened;

a cap connected to the locking seal, the cap having a seal surface that seats into a sealing surface of the orifice of the locking seal to create a positive seal when tightened; and a draw attachment, wherein the cap covers a rubber surface of a liquid medicine bottle so that it remains sealed once the rubber surface has been punctured by the draw attachment.

2. The save-and-draw capping system of claim 1, wherein the cap is a flip-top cap having a plastic hinge.

3. The save-and-draw capping system of claim 2, the flip-top cap further comprising:

a raised nipple on a bottom side that receives a rubber hose for use of the save-and-draw capping system with a remote injection gun.

4. The save-and-draw capping system of claim 1, wherein the cap is a screw-on cap.

5. The save-and-draw capping system of claim 1, the locking seal having a sealing surface on a base that uses the rubber surface of the liquid medicine bottle to form a seal.

6. The save-and-draw capping system of claim 1, the draw attachment comprising:

a tab and a slot capable of attachment to a top of the liquid medicine bottle.

7. The save-and-draw capping system of claim 6, wherein the attachment is through threading or friction.

8. The save-and-draw capping system of claim 1, the draw attachment including a vent to receive air while not letting liquid leak out of the cap when placed on the draw attachment.

9. The save-and-draw capping system of claim 1, wherein the save-and-draw capping system is sized and shaped to fit more than one type of liquid medicine bottle.

10. A save-and draw capping system comprising:

a clamping system that connects to an upper ring of a liquid medicine bottle, the clamping system comprised of two clamps not integral to each other that combine to substantially surround and connect to the upper ring; and a cap secured to the clamping system, the cap having a flip-top lid with a hinge and a seal surface that seats into an orifice of the clamping system to create a positive seal when tightened.

11. The save-and-draw capping system of claim 10 further comprising:

a draw attachment that accesses contents of the liquid medicine bottle through puncturing a rubber surface of the liquid medicine bottle, wherein the cap is closed to cover and seal rubber surface of a liquid medicine bottle once the rubber surface has been punctured by the draw attachment.

12. The save-and-draw capping system of claim 11, wherein the draw attachment is inserted into the liquid medicine bottle by opening the flip-top lid.

13. A save-and draw capping system comprising:

a draw attachment inserted into a liquid medicine bottle and capable of accessing contents of the liquid medicine bottle;

a snap-on system having an orifice and snap-on fingers positioned in a channel of the draw attachment, the snap-on fingers capable of gripping sides of the liquid medicine bottle; and a flip-top cap having a plastic hinge, the flip-top cap connected to the snap-on system, the cap having a seal surface that seats into a sealing surface of the orifice of the snap-on system to create a positive seal when tightened, the flip-top cap further comprising a raised nipple on a bottom side that receives a rubber hose for use of the save-and-draw capping system with a remote injection gun, wherein a rubber surface of a liquid medicine bottle remains sealed once the rubber surface has been punctured by the draw attachment.

14. The save-and-draw capping system of claim 13, the draw attachment including a vent to receive air while not letting liquid leak out of the cap when placed on the draw attachment.

* * * * *